United States Patent [19]

Nair et al.

[11] Patent Number: 4,825,088

[45] Date of Patent: Apr. 25, 1989

[54] LIGHTWEIGHT TITANIUM CASK ASSEMBLY FOR TRANSPORTING RADIOACTIVE MATERIAL

[75] Inventors: Balakrishnan R. Nair, North Huntingdon; Raymond V. Richardson; Raymond M. Mello, both of Greensburg, all of Pa.

[73] Assignee: Westinghouse Electric Corp., Pittsburgh, Pa.

[21] Appl. No.: 114,599

[22] Filed: Oct. 30, 1987

[51] Int. Cl.[4] ..... G21F 5/00

[52] U.S. Cl. ..... 250/506.1; 250/507.1; 376/272

[58] Field of Search ..... 250/506.1, 507.1; 376/272

[56] References Cited

U.S. PATENT DOCUMENTS

| | | | |
|---|---|---|---|
| 3,659,107 | 4/1972 | Selle et al. | 250/506.1 |
| 3,780,306 | 12/1973 | Anderson et al. | 250/507.1 |
| 4,116,337 | 9/1978 | Backus | 206/591 |
| 4,292,528 | 9/1981 | Shaffer et al. | 250/506 |
| 4,336,460 | 6/1982 | Best et al. | 250/506 |
| 4,447,729 | 5/1984 | Doroszlai et al. | 250/506.1 |
| 4,527,065 | 7/1985 | Popp et al. | 250/506.1 |
| 4,650,518 | 3/1987 | Arntzen et al. | 250/506.1 |

FOREIGN PATENT DOCUMENTS

| | | | |
|---|---|---|---|
| 2171632A | 9/1986 | United Kingdom | 250/506.1 |

OTHER PUBLICATIONS

Defense High Level Waste (DHLW)/Defense Generated Remote Handled Transuranic Waste (RH TRU) Dual Purpose Cask, vol. II: Technical Proposal, Jul. 23, 1986. Submitted to U.S. Department of Energy in Response to: RFP No. DE-RP04-86AL33569.

*Primary Examiner*—Carolyn E. Fields
*Assistant Examiner*—Jack I. Berman

[57] ABSTRACT

An improved, lightweight cask assembly is disclosed herein. The cask assembly generally comprises at least two, cylindrically shaped and concentrically disposed structural walls formed from a titanium alloy and a shielding wall disposed within and supported by the titanium structural walls. Both the inner and outer walls are formed from a high-strength titanium alloy. The use of such an alloy advantageously allows the thickness of the inner wall to be minimized, thereby optimizing the shielding geometry of the shielding wall and minimizing the weight of the amount of shielding material used in the cask. The use of such an alloy in the outer structural wall also minimizes the weight of the outer wall thereby contributing to the weight reduction of the cask assembly as a whole. The upper and lower edges of the inner and outer structural walls are bound together by a reinforcing ring and an end plate assembly likewise formed from a titanium alloy. In the preferred embodiment, two separate shielding walls made of depleted uranium and particles of boron suspended in a silicone matrix are disposed in the spaces between inner, intermediate and outer titanium walls, respectively.

30 Claims, 7 Drawing Sheets

LIGHTWEIGHT TITANIUM CASK ASSEMBLY FOR TRANSPORTING RADIOACTIVE MATERIAL

BACKGROUND OF THE INVENTION

This invention generally relates to casks for transporting radioactive materials, and is specifically concerned with an improved lightweight cask assembly having high strength titanium walls for transporting a maximum amount of radioactive material within a given weight limit.

Casks for transporting radioactive materials such as the waste products produced by nuclear power plant facilities are known in the prior art. The purpose of such casks is to ship radioactive wastes in as safe a manner as possible. Such casks may be used, for example, to ship high-level vitrified waste cannisters to a permanent waste isolation site or spent fuel rods to a reprocessing facility. At the present time, relatively few of such transportation casks have been manufactured and used since most of the spent fuel and other wastes generated by nuclear power plants are being stored at the reactor facilities themselves. However, the availability of such on-site storage space is steadily diminishing as an increasing amount of fuel assemblies and other wastes are loaded into the spent-fuel pools of these facilities. Additionally, the U.S. Department of Energy (D.O.E.) has been obligated, by way of the National Waste Policy Act of 1983, to move the spent fuel assemblies from the on-site storage facilities of all nuclear power plants to a federally operated nuclear waste disposal facility starting in 1998.

While the transportation casks of the prior art are generally capable of safely transporting wastes such as spent fuel to a final destination, the applicants have observed that there is considerable room for improvement, particularly with respect to vehicle-drawn, Type B casks. Specifically, the applicants have observed that the structural materials and design configuration used in these casks do not lend themselves to a maximum loading of radioactive wastes. The resulting less-than-maximum loading necessitates a larger number of trips by the shipper in order to complete the transportation of a given amount of radioactive waste, thus increasing both the time and the cost of transport. However, before the problems associated with maximizing the amount of waste carried by a particular cask may be fully appreciated, some understanding of the constraints imposed by U.S. government regulations is necessary.

U.S. Department of Transportation (DOT) and state highway regulations limit the gross weight of the waste carrying road vehicle to about 80,000 pounds for shipments without special permits. Since the typical tractor and trailer weighs approximately 30,000 pounds, the weight of a cask and its contents must not exceed approximately 50,000 pounds. These same regulations specify that the surface radiation of such cask be no greater than 200 millirems at any given point, and that the radiation emitted by the cask be no greater than ten millirems at a distance of two meters from the vehicle. Other DOT regulations require that the cask be capable of sustaining impact stresses of up to ten Gs in the longitudinal direction, five Gs in the lateral direction, and two Gs in the vertical direction without yielding the wastes. The end result of these regulations is that much of the 50,000 pounds must be expended in providing a wall structure that is dense enough to provide adequate shielding and strong enough to withstand the designated impact stresses. The resulting thickness of the wall necessary to provide the required radiation shielding and impact stresses leaves only a relatively small amount of space in the center of the cask which can actually be used to contain and transport radioactive waste. To maximize the amount of carrying volume, the most effective shielding materials known are frequently integrated into the walls of the cask structure. Such materials include lead, depleted uranium, and tungsten. However, as these materials are of a very high density, the radius of the cask walls cannot be made too large, or the gross weight limitation of 50,000 pounds of the combination of cask and waste material will be exceeded. Moreover, as U.S. government regulations require the cask design engineer to assume that such shielding materials have no structural strength and cannot be relied upon at all for compliance with the impact stress requirement, they must be integrated within structural walls which are capable of withstanding the designated stresses. At the present time, stainless steel is the most commonly used structural wall material. The end result of the foregoing constraints of structural strength, shielding effectiveness, and the high density of the most effective known shielding materials results in a very large portion of the 50,000 pounds weight allocation for a loaded cask going to the cask structure itself, rather than the weight of the waste being transported.

If the cost of transporting a particular amount of radioactive waste is to be minimized, then the weight of the cask structure relative to the weight of the waste being carried must be minimized. The applicants have further observed that this objective may be accomplished by the fulfillment of two criteria. First, the radial distance between the waste being carried and the shielding material integrated into the walls of the cask structure must be minimized. If this criteria is realized, an optimum shielding geometry results wherein a maximum amount of shielding is achieved with a minimum weight of shielding material. Second, the structural walls of the cask that overlie and support the shielding material should be fabricated from a material which affords maximum strength per unit weight of wall material. The applicants have further observed that, for many materials, these two criteria are incompatible with one another. Such incompatibility becomes evident when one considers that the interior surface of the shielding material must be lined with an inner structural wall in order to support the shielding material within the cask walls and to comply with the government impact stress regulations. If the distance between the waste and the shielding is to be minimized, then the material forming the inner wall must be as strong as possible per given thickness (or volume) of material. The thicker the material forming this wall is, the greater the distance between the waste and the shielding material, and the greater the radius (and hence weight) of the shielding material. Hence the use of a material such as a high-strength aluminum alloy would not necessarily result in any significant weight decrease of the cask as a whole. Even though such an alloy might be stronger than stainless steel on a pound-per-pound basis, and hence might reduce the weight of the outer structural wall, it would actually increase the weight needed for additional shielding material if the minimum thickness required for the inner wall was greater than the minimum thickness of the inner wall fabricated from stainless steel. The end result is that both of these weight reducing criteria are fulfilled only with a material that is substantially stronger than stainless steel both on a pound-per-pound and a volume-per-volume basis. Such a material would result in an outer structural wall of reduced weight, and would actually decrease the required amount of high density shielding material required to achieve the maximum surface radiation constraints.

Clearly, what is needed is a cask capable of containing a maximum amount of radioactive waste in a structure having a minimum amount of weight. Such a cask must also be capable of conducting and dissipating the heat of decay of the radioactive materials contained therein at least as well as cask wall structures made of stainless steel to avoid the creation of dangerous internal pressures. Finally, such a cask should be relatively simple and inexpensive to fabricate.

SUMMARY OF THE INVENTION

The invention is an improved lightweight cask assembly that achieves the aforementioned objective of carrying a maximum amount of radioactive wastes in a cask structure which conforms to all U.S. government regulations concerning cask weight, surface radiation and impact strength limits. Generally, the improved cask assembly comprises inner and outer structural walls formed substantially from a titanium alloy with a radiation shielding wall disposed therebetween. In the preferred embodiment, the shielding wall may be made of a high-density gamma absorbing material such as depleted uranium, lead or tungsten. To optimize shielding geometry, the inner wall of titanium alloy is rendered thick enough to comply with the impact strength requirement defined by U.S. government regulations within a broad margin of safety, but yet thin enough to provide a minimum distance between the radioactive materials disposed within the interior of the container and the shielding wall.

The structural walls may further include a reinforcing ring for connecting together the top edges of the inner and outer structural walls, as well as an end plate assembly for connecting together the bottom edges of these walls. In the preferred embodiment, both the inner and outer structural walls, the reinforcing ring and the end plate assembly are each formed from a titanium alloy designated as Ti-3-Al-2.5V for its tensile and impact strength, and its relatively easy weldability.

In the preferred embodiment of the cask assembly two separate shielding walls are provided, one for shielding gamma radiation, and the other for shielding neutron radiation. The first of these shielding walls may be an inner wall formed from a gamma-absorbing material such as depleted uranium, while the second of these shielding walls may be an outer shielding wall formed from a neutron-absorbing material such as particles of boron suspended in a matrix of silicone. In such an embodiment, the structural walls of the cask assembly include an inner wall, an intermediate wall and an outer wall all formed from a titanium alloy. The inner shielding wall is disposed and supported between the inner and the intermediate walls, while the outer shielding wall is disposed between and supported by the intermediate and outer structural walls.

The improved cask assembly of the invention not only reduces the weight of the cask structure on the order of fifty percent, but further has superior heat conducting properties which allows the cask structure to conduct and to dissipate the heat of decay of the radioactive materials contained inside in a more efficient manner. This in turn minimizes any internally-generated pressures within the cask assembly, and contributes to the overall safety characteristics of the cask.

BRIEF DESCRIPTION OF THE SEVERAL FIGURES

Figure 6A:
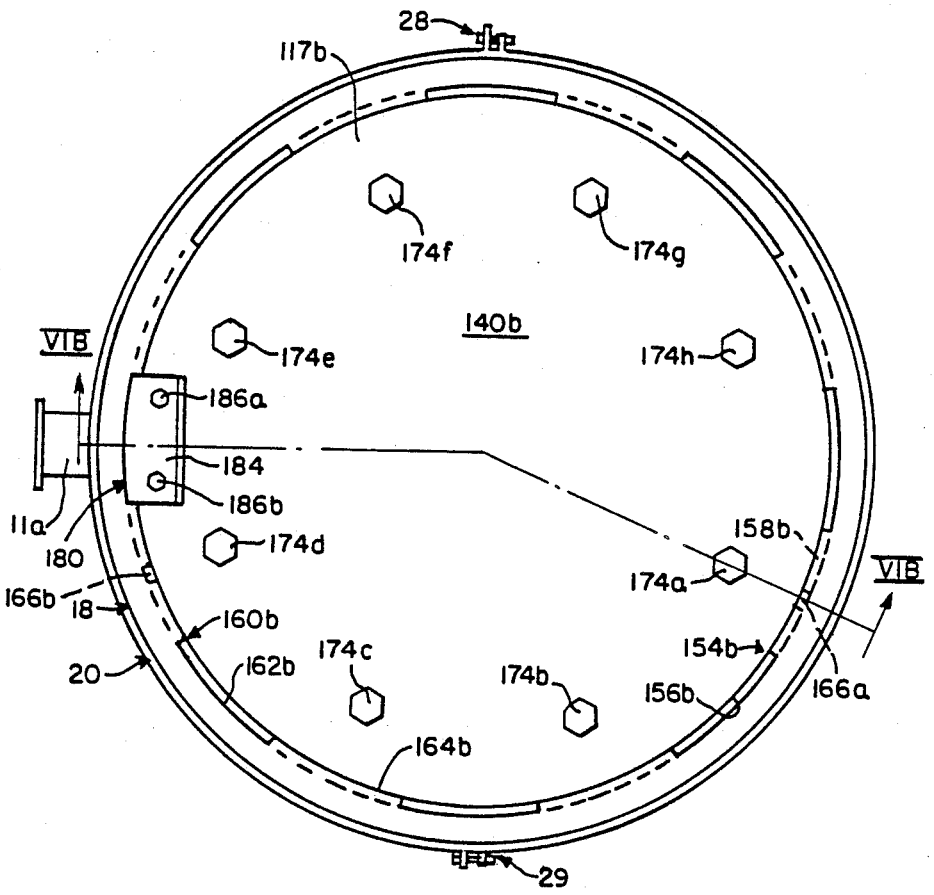
FIG. 6A is a plan view of a breech-lock, double-lidded closure that may be used to close and seal both the shield insert and the outer container.
Figure 6B:
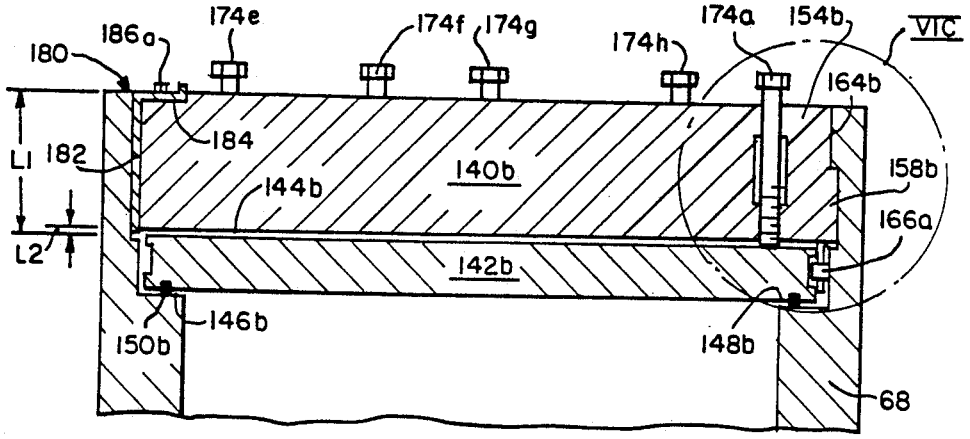
Figure 6C:
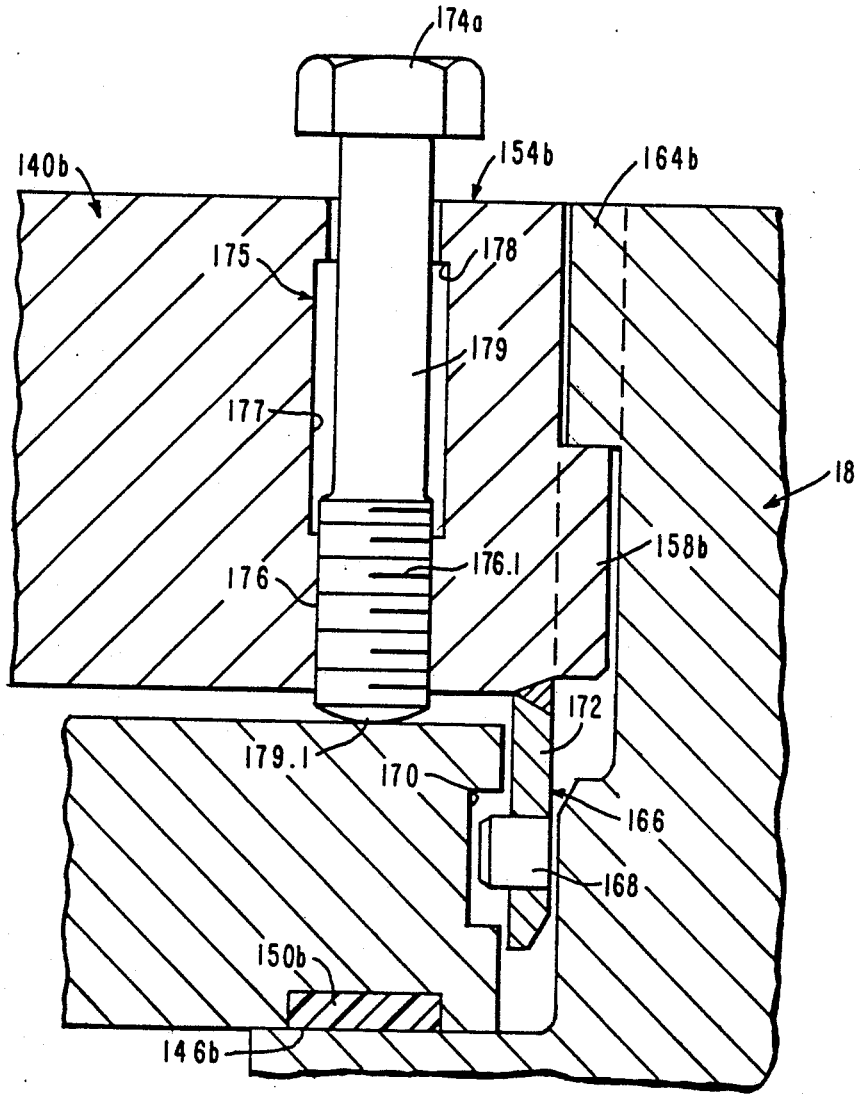

FIG. 6B is a cross sectional view of the closure illustrated in FIG. 6A along the lines 6B—6B, and FIG. 6C is an enlarged view of the area encompassed within the circle in FIG. 6B, illustrating how the flanges and notches which circumscribe the outer edge of the closure and the inner edge of the access opening of the outer container interfit with one another, and further illustrating how the sealing bolts sealingly engage the gasket of the inner lid around this opening.

DETAILED DESCRIPTION OF THE PREFERRED EMBODIMENT

Figure 1:
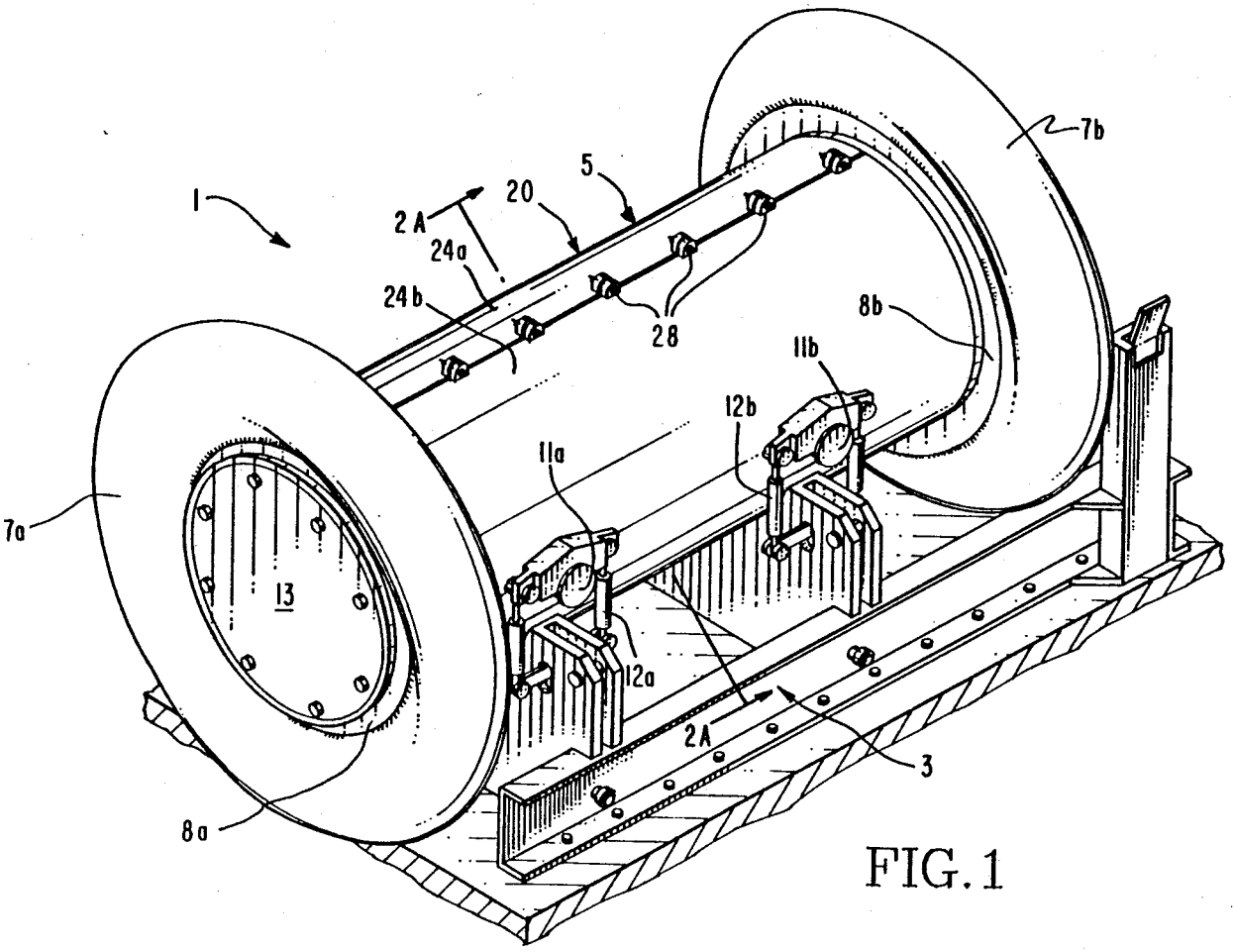
FIG. 1 is a perspective view of the improved cask assembly of the invention as it would appear mounted in a biaxial restraint cradle.
Figure 3:
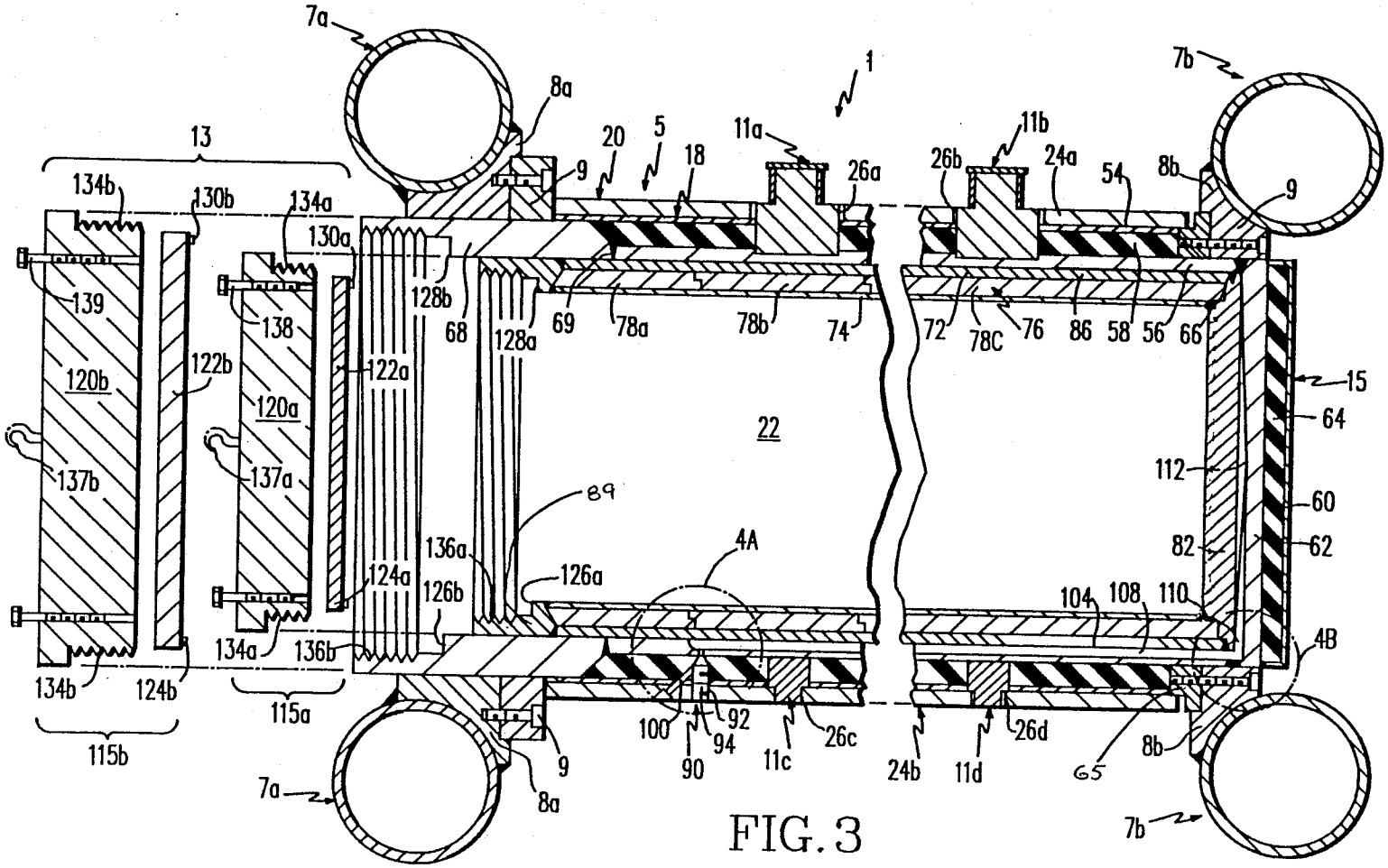
FIG. 3 is a cross sectional side view of the cask assembly, showing how one of the titanium cladded shield inserts slidably fits into the interior of the outer container, and how screw-type, double-lidded closures (shown in exploded form) may be used to close and seal both the shield insert and the outer container.
Figure 5:
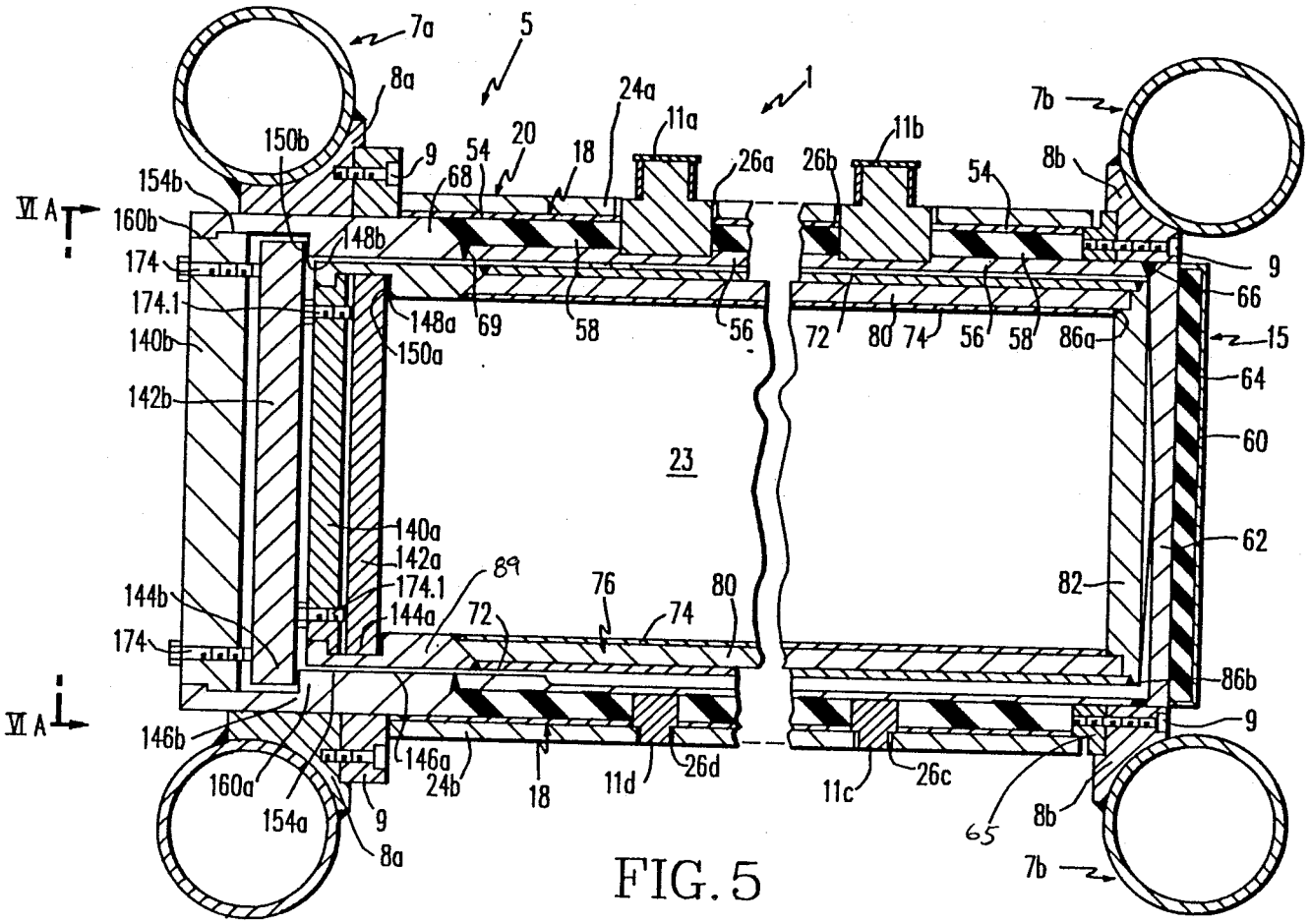
FIG. 5 is a cross sectional side view of the improved cask assembly of the invention, showing an alternative titanium cladded shield insert disposed within the interior of the outer container that is particularly well suited for carrying neutron-emitting radioactive materials.

With reference now to FIG. 1, wherein like numerals designate like components throughout all the several figures, the invention is a lightweight cask assembly 1 having structural walls formed from a titanium alloy that is particularly useful in carrying radioactive materials of different activities aboard a vehicle such as a tractor-trailer. In use, the cask assembly is typically mounted within a novel biaxial restraint cradle 3, which in turn is secured onto the trailer of a tractor-trailer (not shown). Generally, the cask assembly itself has a cylindrical body 5 which is circumscribed on either end by toroidal impact limiters 7a and 7b. Each of these impact limiters 7a, 7b is a donut-shaped shell of yieldable aluminum which is approximately one-half of an inch thick. Each of the toroidal impact limiters 7a, 7b is mounted around its respective end of the cylindrical body 5 by means of a support ring assembly 8a, 8b which in turn is secured to the cylindrical body 5 by a plurality of bolts 9. Support ring assembly 8b is formed from a titanium alloy and is part of the end plate assembly 15 discussed hereinafter. Disposed between the impact limiters 7a, 7b are a pair of opposing trunnions 11a, 11b and 11c, 11d. The two pairs of trunnions are disposed 180 degrees apart around the cylindrical body 5 of the cask assembly 1, and are receivable within two pairs of turnbuckle assemblies 12a, 12b, and 12c, 12d (of which only 12a and 12b are visible) that form part of the cradle 3. The cylindrical body 5 is capped by a closure 13 at one end, and an end plate assembly 15 formed from a titanium alloy (shown in FIG. 3) at the other end. As is best seen in FIGS. 3 and 5, the cylindrical body 5 of the cask assembly 1 is generally formed by an outer container 18 which is surrounded by a thermal protection shell 20 on its exterior, and which contains in its interior one of two different shield inserts 22 or 23, depending upon the activity and type of radiation emitted by the material to be transported. While only two specific types of shield inserts 22 and 23 are specifically disclosed herein, it should be noted that the inserts 22 and 23 are merely exemplary, and that the improved cask assembly may in fact be used with any number of different types of shield inserts formed of different shielding materials having different wall thicknesses for handling radioactive material within a broad range of activity and radiation type.

Figure 2A:
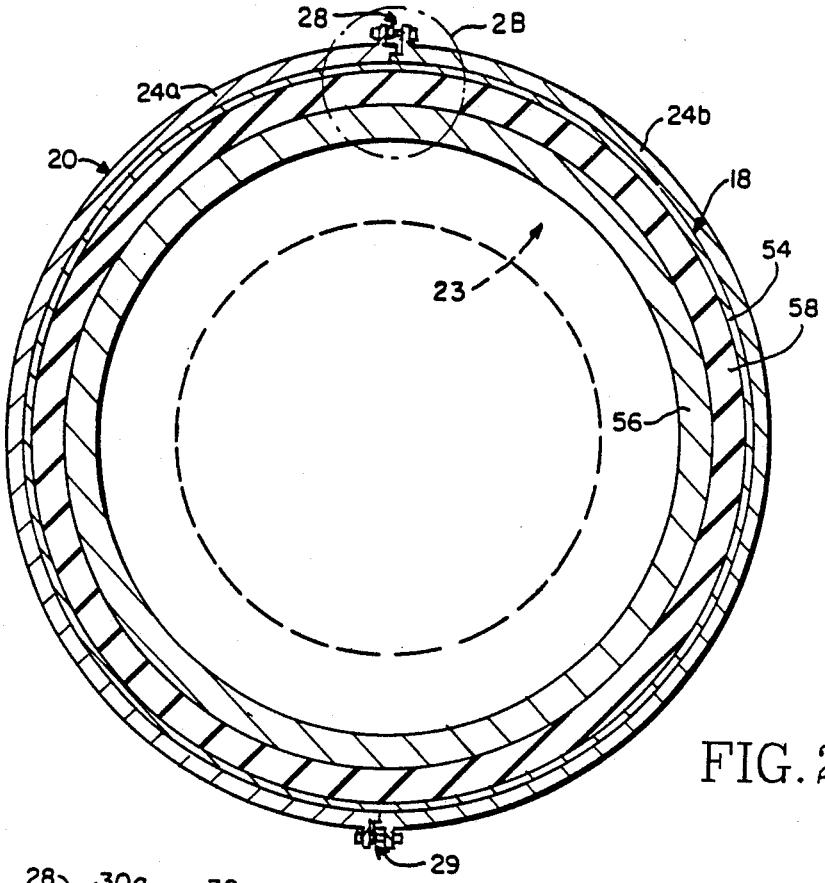
FIG. 2A is a cross sectional view of the improved cask assembly illustrated in FIG. 1 along the line 2A—2A with the toroidal impact limiters removed, showing the titanium structural walls used in the cask assembly.
Figure 2B:
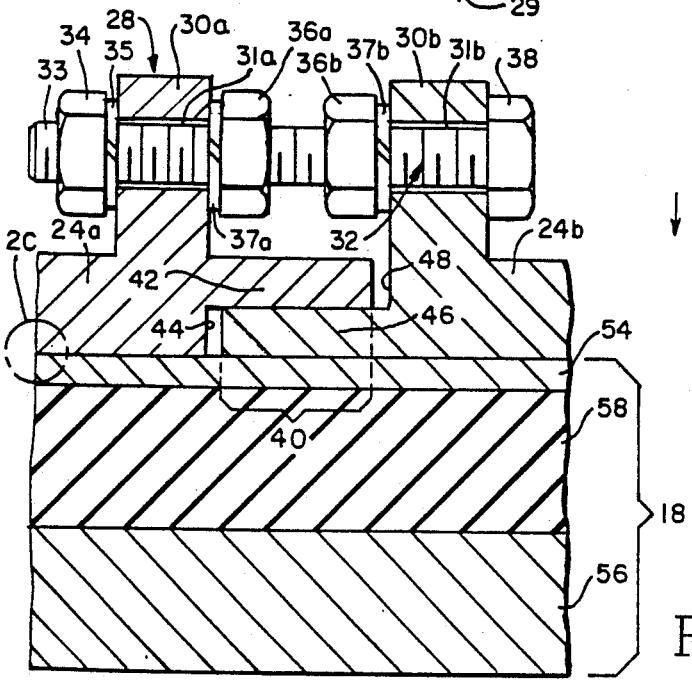
FIG. 2B is an enlarged, cross sectional view of the connecting assembly circled in FIG. 2A which rigidly interconnects the semi-cylindrical sections that form a thermal protection shell for the cask assembly.
Figure 2C:
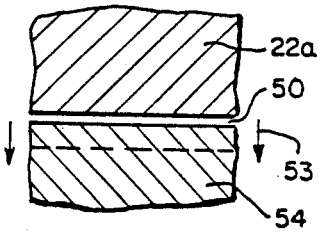
FIG. 2C is an enlargement of the area circled in FIG. 2B, demonstrating how the distance between the outer surface of the outer container and the inner surface of the thermal protection shell increases when the shell is exposed to a source of thermal radiation such as a fire.

With reference now to FIGS. 2A, 2B, and 2C, the thermal protection shell 20 which circumscribes the outer container 18 of the cask assembly 1 is formed from a pair of semi-cylindrical shell sections 24a, 24b which are rigidly interconnectable into thermal contact with one another. Each of the shell sections 24a, 24b includes a pair of cut-outs 26 for admitting the trunnions 11a, 11b, 11c, and 11d. Each of the shell sections 24a, 24b is formed from a metal having a thermal coefficient of expansion which is greater than that of the metal that forms the walls of the outer container 18, and which is at least as heat-conductive as the metal which forms the walls 54 of the outer container 18. When the outer wall of the outer container 18 is formed from titanium, the shell sections 24a, 24b are preferably formed from aluminum or magnesium or an alloy of either or both of these metals. The coefficient of thermal expansion of these metals is approximately twice that of the thermal coefficient of expansion of titanium. Moreover, the high coefficient of thermal conductivity of each such metal insures that the thermal protection shell 20 will not significantly obstruct the conduction of decay heat conducted through the walls of the outer container 18 which is generated by the radioactive material held within the cask assembly 1. When the diameter of the outer container 18 is between forty and sixty inches, a wall thickness of approximately one-half of an inch is preferred for both of the shell sections 24a, 24b. Such a wall thickness renders the thermal protection shell 20, as a whole, thin enough to be conveniently retrofitted over many existing transportation casks without significantly adding to the weight thereof, yet is thick enough to maintain the structural integrity needed to expand away from the outer walls of the outer container when exposed to a source of intense thermal radiation, such as a fire. Finally, the preferred thickness of one-half on an inch provides enough mass to give the entire thermal protection shell 20 a significant latent heat of fusion, which will provide still more thermal protection through ablation should the cask 1 be exposed to intense heat.

A plurality of top and bottom connecting assemblies 28, 29 are used to rigidly interconnect the two semi-cylindrical shell sections 24a, 24b. Since each of the connecting assemblies 28, 29 are identical in structure, a description will be made only of the top connecting assembly 28 circled in FIG. 2A.

This connecting assembly 28 is formed from a pair of opposing semicircular lugs 30a and 30b which are integrally formed along the edges of the shell sections 24a and 24b respectively. These lugs 30a, 30b include mutually alignable bore holes 31a and 31b for receiving a connecting bolt 32. The threaded end 33 of the bolt 32 is engaged to a tension nut 34 as shown in FIG. 2B. The distance between the two lugs 30a, 30b (and hence the distance between the edges of the shell sections 24a, 24b) is largely determined by the extent of which the end 33 of the bolt 32 is threaded through the tension nut 34. A lock washer 35 is disposed between the tension nut 34 and the lug 30a to prevent the nut 34 from becoming inadvertently loosened. A pair of lock nuts 36a, 36b are threadedly engaged near the center portion of the connecting bolt 32 between the two lugs 30a and 30b. These lock nuts provide two functions. First, when properly adjusted, they prevent the tension nut 34 from applying excess tensile forces between the two shell sections 24a and 24b which might interfere with their expansion away from the outer container 18 in the event the cask assembly is exposed to a fire or other source of intense heat. Second, the nuts 36a, 36b eliminate all slack or play between the lugs 30a, 30b, thus insuring that the connecting assembly 28 rigidly interconnects the two shield sections 30a, 30b. Again, lock washers 37a, 37b are disposed between the lock nuts 36a and 36b and their respective lugs 30a and 30b to prevent any inadvertent loosening from occurring.

An overlap 40 is provided between the edges of the two shell sections 24a and 24b to establish ample thermal contact and hence thermal conductivity between these shell sections. The overlap 40 is formed from an outer flange 42 and recess 44 provided along the edge of shell section 24a which interfits with a complementary outer flange 46 and recess 48 provided along the opposing edge of shield section 24b. The actual length of the overlap 40 will vary depending upon the distance between the two lugs 30a and 30b as adjusted by the bolt 32, tension nut 34, and lock nuts 36a and 36b.

In operation, the two sections 24a, 24b of the thermal protection shell 20 are installed over the cask assembly 1 by aligning the various cutouts 26a, 26b, 26c, and 26d with the corresponding trunnions of 11a, 11b, 11c, and 11d which project from the cylindrical body 5, and placing the sections 24a, 24b together so that the lugs 30a and 30b of each of the connecting assemblies 28, 29 are in alignment with one another and the flanges and recesses 42, 44, and 48, 46 of each overlaps 40 are interfitted. Next, the bolt 32, tension nut 35, lock nuts 36a, 36b, and lock washers 35, 37a, and 37b are installed in their proper positions with respect to the lugs 30a, 30b of each of the connecting assemblies 28, 29. The tension nut 34 is then screwed over the threaded end 33 of connecting bolt 32 until the interior surface of each of the shell sections 24*a* and 24*b* is pulled into intimate thermal contact with the outside wall 54 of the outer container 18. In the preferred method of installing the thermal protection shield, the tension nut 34 of each of the connecting assemblies 28, 29 is initially torqued to a selected maximum on the threaded shaft of the bolt 32 until the nut 34 imparts a significant tensile force between the two lugs 30*a* and 30*b*. This tensile force tends to squeeze the two shell sections 24*a* and 24*b* together around the outer wall 54 of the outer container 18 in a clamp-like fashion, which in turn removes any significant gaps between the outer surface of the wall 54 and the inner surface of the shell sections 24*a* and 24*b* by bending these sections into conformity with one another. In the next step, each of the nuts 34 is relaxed enough to prevent these tensile clamping forces from interfering with the expansion of the thermal protection shell 20 in the event of a fire, yet not so much as to cause the surfaces of the shell 20 and the outer container from becoming disengaged with one another. Thereafter, the lock nuts 36*a* and 36*b* are tightened against the faces of their respective lugs 30*a* and 30*b* to remove all slack in each connecting assembly 28, 29. The end result is a rigid interconnection between opposing edges of the shield sections 24*a* and 24*b*, wherein each of the opposing lugs 30*a* and 30*b* is tightly sandwiched between the tension nut 34 and lock nut 36*a*, or the head of the bolt 38 and lock nut 36*b*, respectively.

If the outer container has no trunnions 11*a*, 11*b*, 11*c*, 11*d*, or other structural members which would prevent the surfaces of the shell 20 and outer container 18 from coming into intimate thermal contact, the shell 20 may assume the form of a tubular sleeve which may be, in effect, heat shrunk into contact over the container 18. This alternative method of installation comprises the steps removing the impact limiters 7*a*, 7*b*, of heating the shell to a temperature sufficient to radially expand it, sliding it over the wall 54 of the outer container 18, allowing it to cool and contract into intimate thermal contact with the wall 54, and reinstalling the impact limiters 7*a*, 7*b*.

FIG. 2C illustrates the typical gap condition between the inner surface of the thermal protection shell 20 and the outer surface of the outer container 18. Under ambient conditions, these two opposing surfaces are either in direct contact with one another, or separated by only a tiny gap 50 which may be as much as one mil. Such a one mil separation at various points around the cask assembly 1 does not significantly interfere with the conduction of heat between the wall 54 of outer cask 18, and the thermal protection shell 20. However, when the cask assembly 1 is exposed to a source of intense thermal radiation such as a fire, the substantially higher thermal coefficient of expansion of the aluminum or magnesium forming the shell 20 will cause it to expand radially away from the outer surface of the outer container 18, leaving an air gap 53 (shown in phantom) between the two surfaces. Moreover, since the thermal protection shield 20 is formed from a metal having good heat conductive properties, this differential thermal expansion is substantially uniform throughout the entire circumference of the shield 20, which means that the resulting insulatory air gap 53 is likewise substantially uniform. When this gap exceeds approximately two and one-half mils, the primary mode of heat transfer switches from conductive and convective to radiative. Thus the three mil gap provides a substantial thermal resistor between the fire or other source of intense infrared radiation in the outer container 18 of the cask 1.

With reference now to FIGS. 3, 4A, 4B, and 5, the side walls of the outer container 18 of the improved cask 1 are a laminate formed from the previously mentioned outer wall 54, an inner wall 56, and a center layer 58 of shielding material. In the preferred embodiment, both the outer wall 54 and inner wall 56 is formed from a high strength alloy of titantium, such as Ti-3-Al-2.5-V, or Ti-6-Al-4-V. Such a titanium alloy is approximately three to four times stronger than most stainless steel on a pound-per-pound basis. Moreover, because titanium is about half the density of most stainless steels, this titanium alloy is about 75% to 100% stronger than most stainless steel on a volume-per-volume basis. The end result is that both the outer wall 54 and the inner wall 56 may be made substantially thinner with a material only about one-half as dense as stainless or low alloy steel. Hence the savings in weight are manifest. While other high strength alloys of titanium may be used, Ti-3-Al-2.5-V is preferred for its easy weldability. Disposed between the outer wall 54 and the inner wall 56 is a layer of Boro-Silicone, which is a shielding material formed from particles of boron suspended in a matrix of silicone. This material advantageously absorbs neutrons from neutron-emitting radioactive materials (such as transuranic elements), and further is a relatively good conductor of heat. It is a rubbery material easily cast, and may be melted and poured between the inner and outer walls 54, 56 of the outer container 18 during it manufacture. Boro-Silicone is available from Reactor Experiments, Inc., and is a registered trademark of this corporation.

The bottom of the outer container 18 is formed by an end plate assembly 15 that includes an outer plate 60, an inner plate 62, a layer of center shielding material 64, the previously mentioned support ring assembly 8*b* and a lower reinforcing ring 65. In the preferred embodiment, the outer plate 60 is again formed from a titanium alloy such as Ti-3-Al-2.5-V approximately one-eighth inch thick. The inner plate 62, like the inner wall 56, is again formed from Ti-3-Al-2.5-V approximately one inch thick. The center shielding material 64 is again preferably Boro-Silicone for all the reasons mentioned in connection with the center shielding material 58 of the side walls of the container 18. The titanium alloy inner plate 62 is joined around the bottom edge of the inner wall 56 360 degrees via weld joint 66. The top of the outer container 18 includes a reinforcing ring 68 again made of Ti-3-Al-2.5-V. This ring 68 is preferably about two inches thick throughout its length, and is integrally connected to the inner wall 56 of the container 18 by a 360 degree weld joint 69. The upper edge of the ring 68 is either threaded or stepped to accommodate one of the two types of improved closures 115*b* or 117*b*, as will be explained in detail hereinafter.

With specific reference now to FIGS. 3 and 5, the cask assembly 1 is formed from the outer container 18 and shell 20 in combination with one of two different shield inserts 22 (illustrated in FIG. 3) or 23 (illustrated in FIG. 5). Each of the shield inserts 22, 23 is formed from an outer cylindrical wall 72 which is preferably one-half inch thick and a cylindrical inner wall 74 which is approximately one-eighth of Ti-3-Al-2.5-V. Each of the shield inserts 22 and 23 includes a layer of shielding material 76 between their respective outer and inner walls 72, 74. However, in shield insert 22, this shielding material is formed from a plurality of ring-like sections 78*a*, 78*b*, and 78*c* of either depleted uranium or tungsten. These materials have excellent gamma shielding properties, and are particularly well adapted to contain and shield radioactive material emitting high intensity gamma radiation. Of course, a single tubular layer of depleted uranium or tungsten could be used in lieu of the three stacked ring-like sections 78*a*, 78*b*, and 78*c*. However, the use of the stacked ring-like sections is preferred due to the difficulty of fabricating and machining these metals. To effectively avoid radiation streaming at the junctions between the three sections, overlapping tongue and groove joints 79 (see FIG. 4A) are provided at each junction. By contrast, in shield insert 23, a layer of poured lead 80 is used as the shielding material 76. While lead is not as effective a gamma shield as depleted uranium, it is a better material to use in connection with high-neutron emitting materials, such as the transuranic elements. Such high neutron emitters can induce secondary neutron emission when depleted uranium is used as a shielding material. While such a secondary neutron emission is not a problem with tungsten, this metal is far more difficult and expensive to fabricate than lead, and is only marginally better as a gamma-absorber. Therefore, lead is a preferred shielding material when high-neutron emitting materials are to be transported. In both of the shield inserts 22, 23, the bottom edges of the inner and outer walls 72, 74 are welded around a bottom plate 82, while the upper edges of these walls are both welded around an insert reinforcing ring 89. Both bottom plate 82 and ring 89 are formed from Ti-3-Al-2.5V.

It should be noted that in the preferred embodiment, the use of a high strength titanium alloy such as Ti-3-Al-2.5V allows the inner wall 74 of each of the shield inserts 22 and 23 to be much thinner than if this wall were made of steel and yet still comply with the U.S. government impact stress criteria. Such thin inner wall minimizes the distance between the shielding material 76 and the radioactive waste disposed inside the insert 22, 23, which in turn minimizes the weight of the shielding material 76 required to meet U.S. government surface radiation requirements. The radius of the interior of the shield inserts 22 and 23 will be custom dimensioned with a particular type of waste to be transported so that the inner wall 74 of the insert comes as close as possible into contact with the radioactive material contained therein. The applicants have noted that fulfillment of the foregoing criteria provides the most effective shielding configuration per weight of shielding material. Additionally, the thickness and type of shielding material 76 will be adjusted in accordance with the activity of the material contained within the shield insert 22, 23 so that the surface radiation of the cask assembly 1 never exceeds 200 mr. The fulfillment of all these criteria maximizes the capacity of the cask assembly 1 to carry radioactive materials while simultaneously minimizing the weight of the cask.

The use of titanium alloy in the outer and inner walls 54, 56, 72, 74 of both the outer container 18 and shield inserts 22, 23 has the further advantage of enhancing the overall thermal conductivity of the cask assembly. Despite the fact that the heat conductivity of titanium is only about half as great as the heat conductivity of conventional structural materials such as 304 stainless steel, the fact that the walls 54, 56, 72 and 74 may be made so much thinner as a result of the higher strength of titanium more than offsets the difference in thermal conductivity. The end result is that the use of titanium not only results in a lighter-weight cask, but a safer cask capable of more effectively dissipating the heat of decay of the radioactive materials contained therein, hence insuring that this heat will not create unwanted pressures with the cask assembly 1.

Figure 4B:
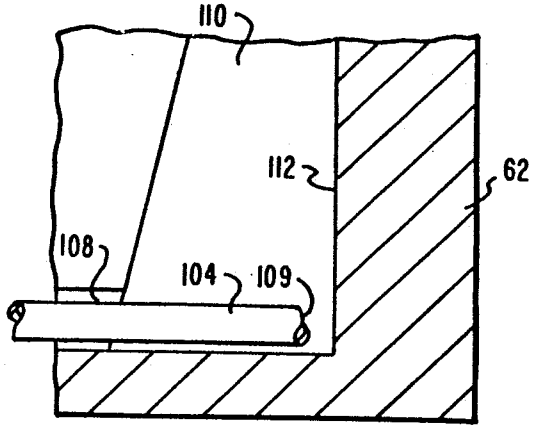
FIG. 4B is a cross sectional side view of the area encompassed within the lower circle in FIG. 3, showing how the bottom end of the drain tube fits into a fluid conducting groove cut into the conical bottom of the outer container of the cask assembly.
Figure 4A:
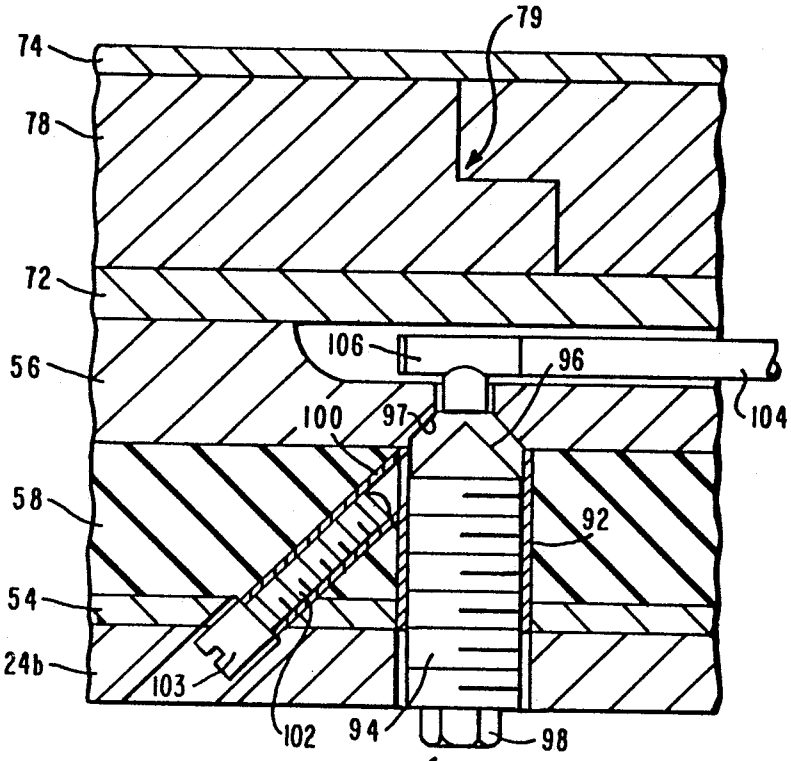
FIG. 4A is an enlarged cross sectional side view of the vent, purge, and drain assembly circled in FIG. 3, showing the drain pipe, the vent pipe, the drain and vent plugs, and the drain tube thereof.

FIGS. 4A and 4B illustrate the vent, purge, and drain assembly 90 of the outer container 18. This assembly 90 includes a threaded drain pipe 92 for receiving a drain plug 94. The inner end 96 of the drain plug 94 is conically shaped and seatable in sealing engagement with a complementary valve seat 97 located at the inner end of the pipe 92. Wrench flats 98 integrally formed at the outer end of the drain plug 94 allow the plug 94 to be easily grasped and rotated into or out of sealing engagement with the valve seat 94. A vent pipe 100 is obliquely disposed in fluid communication with the end of the drain pipe 92. A threaded vent plug 102 is engageable into and out of the vent pipe 100. A screw head 103 is provided at the outer end of the vent plug 102 to facilitate the removal and insertion of the threaded plug 102 into the threaded interior of the vent pipe 100. A drain tube 104 is fluidly connected at is upper end to the bottom of the valve seat 97 by way of a fitting 106. In the preferred embodiment, the drain tube 104 is formed from stainless steel, and is housed in a side groove 108 provided along the inner surface of the wall 56 of the outer container 18. As is most easily seen in FIG. 4B, the lower open end 109 of the drain tube 104 is disposed in a bottom groove 110 which extends through the shallowly conical floor 112 of the outer container 18.

In operation, the vent, purge, and drain assembly may be used to vent the interior of the outer container 18 by removing the vent plug 102 from the vent pipe 100, screwing an appropriate fitting (not shown) into the threaded vent pipe 100 in order to channel gases to a mass spectrometer, and simply screwing the conical end 96 of the drain plug 94 out of sealing engagement with the valve seat 97. If drainage is desired, the drain plug 94 is again removed. A suction pump is connected to the drain pipe 92 in order to pull out, via drain tube 104, any liquids which may have collected in the bottom groove 110 of the conical floor 112 of the outer container 18. Gas purging is preferably accomplished after draining by removing the vent plug 102, and connecting a source of inert gas to the drain pipe 92. The partial vacuum within the container 18 that was created by the suction pump encourages inert gas to flow down through the drain tube 104. Although not specifically shown, the interior of the drain plug 98 may be provided with one or more rupture discs to provide for emergency pressure relief in the event that the cask assembly 1 is exposed to a source of intense thermal radiation, such as a fire, over a protracted period of time.

The closure 13 used in connection with the cask 1 may be either screw-type double-lidded closures 115*a*, 115*b* (illustrated in FIG. 3), or breech-lock double-lidded closures 117*a*, 117*b* (illustrated in FIG. 5).

With reference now to FIG. 3, each of the screw-type closures 115*a*, 115*b* includes an outer lid 120*a*, 120*b*, and an inner lid 122*a*, 122*b*. The inner lid 122*a*, 122*b* in turn includes an outer edge 124*a*, 124*b* which is seatable over the ledge 126*a*, 126*b* provided around the opening 128*a*, 128*b* of the shield insert 22 or the outer container 18 respectively. A gasket 130*a*, 130*b* circumscribes the outer edge 124*a*, 124*b* of each of the inner lids 122*a*, 122*b* of the two closures 115*a*, 115*b*. In the preferred embodiment, these gaskets 130*a*, 130*b* are formed of Viton because of its excellent sealing characteristics and relatively high temperature limit (392 degrees F.) compared to other elastomers. The gasket 130*a*, 130*b* of each of the inner lids 122*a* and 122*b* is preferably received and held within an annular recess (not shown) that circumscribes the outer edge 124*a*, 124*b* of each of the inner lids 122*a*, 122*b* and the ledges 126*a*, 126*b*. To facilitate the insertion of shield insert 22 into the container 18, it is important to note that the opening 128*b* of the container 18 is at least as wide as the interior of the container 18 at all points.

Each of the outer lids 120*a*, 120*b* of the screw-type closures 115*a*, 115*b* includes a threaded outer edge 134*a*, 134*b* which is engageable within a threaded inner edge 136*a*, 136*b* that circumscribes the openings 128*a*, 128*b* of the shield insert 22 and the outer container 18 respectively. Swivel hooks 137*a*, 137*b* (indicated in phantom) may be detachably mounted to the centers of the outer lids 120*a*, 120*b* to facilitate the closure operation. Finally, both the outer lids 120*a*, 120*b* of the screw-type closures 115*a*, 115*b* includes a plurality of sealing bolts 138*a–h*, 139*a–h*, threadedly engaged in bores extending all the way through the outer lids 120*a*, 120*b* for a purpose which will become apparent shortly.

To seal the cask assembly 1, inner lid 122*a* is lowered over ledge 126*a* of the shield insert 22 so that the gasket 130 is disposed between the outer edge 124*a* of the inner ledge 122*a* and ledge 126*a*. The detachably mountable swivel hook 137 is mounted onto the center of the outer lid 120*a*. The outer lid 120*a* is then hoisted over the threaded inner edge 136*a* of the shield insert 22. The threaded outer edge 136*a* of the shield insert is then screwed into the threaded inner edge 136*a* to the maximum extent possible. The axial length of the screw threads 134*a* and 136*a* are dimensioned so that, after the outer lid 120*a* is screwed into the opening 128*a* to the maximum extent possible, a gap will exist between the inner surface of the outer lid 120*a* and the outer surface of the inner lid 122*a*. Once this has been accomplished, the securing bolts 138*a–h* are each screwed completely through their respective bores in the outer lid 120*a* so that they come into engagement with the inner lid 122*a*, thereby pressing the gasket 130*a* and into sealing engagement between the ledge 126*a* and the outer edge 124*a* of the lid 122*a*. The particulars of this last step will become more apparent with the description of the operation of the breech-lock double-lidded closures 117*a*, 117*b* described hereinafter. To complete the closure of the cask assembly 1, the outer screw-type closure 115*b* is mounted over the opening 128*b* of the outer container 18 in precisely the same fashion as described with respect to the opening 128*a* of the shield insert 22.

With reference now to FIGS. 5, 6A, and 6B, the breech-lock double-lidded closure 117*a*, 117*b* also includes a pair of outer lids 140*a*, 140 which overlie a pair of inner lids 142*a*, 142*b* respectively. Each of the inner lids 142*a*, 142*b* likewise includes an outer edge 144*a*, 144*b* which seats over a ledge 146*a*, 146*b* that circumscribes the opening 148*a*, 148*b* of the shielding insert 23 and outer container 18, respectively. Each of the outer edges 144*a*, 144*b* is circumscribed by a gasket 150*a*, 150*b* for effecting a seal between the edges 144*a*, 144*b* and their respective ledges 146*a*, 146*b*. Like opening 128*b*, opening 148*b* is at least as wide as the interior of the outer container 18.

Thus far, the structure of the breech-lock double-lidded closures 117*a*, 117*b* has been essentially identical with the previously described structure of the screw-type double-lidded closures 115*a*, 115*b*. However, in lieu of the previously described screw threads 134*a*, 134*b*, the outer edges 154*a*, 154*b* of each of the outer lids 140*a*, 140*b* are circumscribed by a plurality of uniformly spaced arcuate notches 156*a*, 156*b* which define a plurality of arcuate flanges 158*a*, 158*b*. Similarly, the inner edges 160*a*, 160*b* which circumscribe each of the openings 148*a*, 148*b* of the shield insert 23 and outer container 18, respectively, include notches 162*a*, 162*b* which circumscribe the inner edges 160*a*, 160*b* of the shield insert 23 and the outer container 18. As may best be seen in FIG. 6A and 6C, such dimensioning allows the flanges 164*a*, 164*b* of each of the outer lids 140*a*, 140*b*, to be inserted through the notches 162*a*, 162*b* of each of the openings 148*a*. 148*b* and rotated a few degrees to a securely locked position wherein the arcuate flanges 158*a*, 158*b* of the outer lids 140*a*, 140*b* are overlapped and captured by the arcuate flanges 164*a*, 164*b* that circumscribe the inner edges 160*a*, 160*b*. It should be further noted that the axial length L1 (illustrated in FIG. 6B) of the interlocking flanges 158*a*, 158*b* and 164*a*, 164*b* is sufficiently short to leave a small gap L2 between the inner surface of the outer lids 140*a*, 140*b* and the outer surface of the inner lids 142*a*, 142*b*. The provision of such a small distance L2 between the outer and inner lids allows the outer lids 140*a*, 140*b* to be rotated a few degrees into interlocking relationship with their respective notched inner edges 160*a*, 160*b* without transmitting any rotary motion to the inner lids 142*a*, 142*b* which could cause the inner lid gaskets 150*a*, 150*b* to scrape or wipe across their respective ledges 146*a*, 146*b*.

Connected around the outer edges of the outer lids 140*a*, 140*b* are three suspension pin assemblies 166*a*, 166*b*, and 166*c* and 167*a*, 167*b*, 167*c* are uniformly spaced 120 degrees apart on the edges of their respective outer lids 140*a*, 140*b*. As the structure of each suspension pin assembly is the same, only a suspension pin assembly 166*a* will be described.

With reference now to FIG. 6C, suspension pin assembly 166*a* includes a suspension pin 168 which is slideably movable along an annular groove 170 provided around the circumference of each of the inner ledges 142*a*, 142*b*. A simple straight-leg bracket 172 connects the suspension pin 168 to the bottom edge of its respective outer lid.

In operation, the suspension pin assemblies 166*a*, 166*b*, 166*c*, and 167*a*, 167*b*, 167*c*, serve two functions. First the three suspension pin assemblies attached around the edges of the two outer lids 140*a* and 140*b* mechanically connect and thus unitize the inner and outer lids of each of the breech-lock closures 117*a*, 117*b* so that both the inner and the outer lids of each of the closures 177*a* and 117*b* may be conveniently lifted and lowered over its respective opening 148*a*, 148*b* in a single convenient operation. Secondly, the pin-and-groove interconnection between the inner and the outer lids of each of the two breech-lock type closures 117*a* and 117*b* allows the outer lids 140*a* and 140*b* to be rotated the extent necessary to secure them to the notched outer edges 160*a*, 160*b* of their respective containers without imparting any significant amount of torque to their respective inner lids 142*a*, 142*b*. This advantageous mechanical action in turn prevents the gaskets 150*a* and 150*b* from being wiped or otherwise scraped across their respective ledges 146*a*, 146*b*. In the preferred embodiment, the width of the groove 170 is deliberately made to be substantially larger than the width of the pin 168 so that the pin 168 may avoid any contact with the groove 170 when the outer lids 140*a*, 140*b* are rotated into interlocking relationship with their respective containers 23 and 18.

With reference again to FIG. 6A and 6C, each of the outer lids 140*a*, 140*b* includes eight sealing bolts 174*a–h*, 174.1*a–h* equidistantly disposed around its circumference. Each of these sealing bolts 174*a–h*, 174.1*a–h* is receivable within a bore 175 best seen in FIG. 6C.

Each of these bores 175 includes a bottom-threaded portion 176 which is engageable with the threads 176.1 of its respective bolt 174*a–h*, 174.1*a–h* as well as a centrally disposed, non-threaded housing portion 177. At its upper portion the bore 175 includes an annular retaining shoulder 178 which closely circumscribes the shank 179 of its respective bolt 174*a–h*, 174.1*a–h*. The retaining shoulder 178 insures that none of the sealing bolts 174*a–h*, 174.1*a–h* will inadvertently fall out of its respective bore 175 in the outer lid 140*a*, 140*b*. In operation, each of the sealing bolts 174*a–h* is screwed upwardly into its respective bore 175 until its distal end 179.1 is recessed within the threaded portion 176 of the bore 175. After the outer lid 140*a* or 140*b* has been secured into the notched inner edge 160*a* or 160*b* of its respective container 23 or 18, the sealing bolts 174*a–h* are screwed down into the position illustrated in FIG. 6C until their distal ends 179.1 forcefully apply a downward-direction force around the outer edges 144*a*, 144*b* of their respective inner lids 142*a*, 142*b*. Such a force presses the gaskets 150*a* and 150*b* into sealing engagement against their respective ledges 146*a*, 146*b*. It should be noted that the same bolt and bore configuration is heretofore described is utilized in the screw-type double-lidded closures 115*a*, 115*b*.

To insure that the outer lids 140*a* and 140*b* will not become inadvertently rotated out of locking engagement with their respective vessels 23 or 18, a locking bracket 180 is provided in the position illustrated in FIG. 6A and 6B in each of the outer lids 140*a*, 140*b* after they are rotated shut. Each locking bracket 180 includes a lock leg 182 which is slid through mutually registering notches 156*a*, 156*b*, and 162*a*, 162*b* after the outer lids 140*a* and 140*b* have been rotated into locking engagement with the inner edges 160*a*, 160*b* of either the shielding insert 23 or the outer container 18. In the case of outer lid 140*b*, the mounting leg 184 is secured by means of locking nuts 186*a*, 186*b*. In the case of outer lid 140*a*, the mounting leg 184 is captured in place by inner lid 142*b* which abuts against it. Although not specifically shown in any of the drawings, each of the outer lids 120*a*, 120*b* of the screw-type double-lidded closures 115*a*, 115*b* is similarly secured. However, instead of a locking bracket 180, a locking screw (not shown) is screwed down through the outer edges of each of the outer lids 120*a*, 120*b* and into a recess precut in each of the inner lids 122*a*, 122*b*.

We claim:

1. An improved cask assembly for containing radioactive materials, comprising a container having a shielding wall substantially formed from a radiation shielding material, and structural walls formed at least in part by titanium for supporting said shielding wall.

2. An improved cask assembly as defined in claim 1, wherein said shielding wall includes depleted uranium.

3. An improved cask assembly as defined in claim 1, wherein said shielding wall includes lead.

4. An improved cask assembly as defined in claim 1, wherein said shielding wall includes particles of boron suspended in a matrix of silicone.

5. An improved cask assembly as defined in claim 1, wherein said shielding wall includes tungsten.

6. An improved cask assembly as defined in claim 1, wherein said structural walls include an inner wall and an outer wall, and wherein said shielding wall is disposed between said inner and outer walls.

7. An improved cask assembly as defined in claim 6, wherein said structural walls further include a reinforcing ring also formed at least in part by titanium for interconnecting one end of said inner and outer walls.

8. An improved cask assembly as defined in claim 7, wherein said structural walls further include an end plate assembly also formed at least in part by titanium for interconnecting the other end of said inner and outer walls.

9. An improved cask assembly as defined in claim 6, wherein said inner wall and outer wall are substantially formed from a titanium alloy.

10. An improved cask assembly as defined in claim 6, wherein the inner wall is thick enough to support the shielding wall, yet thin enough to provide a minimum distance between radioactive materials disposed within the interior of the container and the shielding wall.

11. An improved cask assembly for containing radioactive materials, comprising a cylindrical container having a shielding wall substantially formed from a radiation shielding material, and structural walls including inner and outer walls circumscribing the inner and outer surfaces of the shielding wall for supporting said shielding wall, wherein said structural walls are formed substantially from a titanium alloy.

12. An improved cask assembly as defined in claim 11, wherein the inner wall is thick enough to support the shielding wall, yet thin enough to provide a minimum distance between the radioactive materials disposed within the interior of the container and the shielding wall.

13. An improved cask assembly as defined in claim 11, wherein the shielding wall is formed substantially from depleted uranium.

14. An improved cask assembly as defined in claim 11, wherein the shielding wall is formed substantially from lead.

15. An improved cask assembly as defined in claim 11, wherein the shielding wall is formed substantially from tungsten.

16. An improved cask assembly as defined in claim 11, wherein the shielding wall is formed substantially from particles of boron suspended in a matrix of silicone.

17. An improved cask assembly as defined in claim 11, wherein a reinforcing ring also formed substantially from a titanium alloy for interconnecting one end of said inner and outer walls.

18. An improved cask assembly as defined in claim 17, wherein said structural walls further include an end plate assembly also formed substantially from a titanium alloy for interconnecting the other end of said inner and outer walls.

19. An improved cask assembly as defined in claim 18, wherein said end plate assembly includes a layer of shielding material.

20. An improved cask assembly as defined in claim 19, wherein said layer of shielding material is formed from particles of boron suspended in a matrix of silicone.

21. An improved cask assembly for containing and transporting radioactive material of the type required to meet selected minimum strength and maximum weight criteria, comprising a cylindrical container structure having at least one shielding wall substantially formed from a radiation shielding material, inner and outer structural walls circumscribing the inner and outer surfaces of the shielding wall respectively, for supporting said shielding wall and for providing structural strength to the cask assembly, the interior of the cask assembly being defined by the inner wall, wherein said inner wall is substantially formed from a titanium alloy so that the thickness of said wall may be minimized, thereby minimizing the distance between the shielding wall and the radioactive wastes disposed in the interior of the cask assembly, and wherein the outer wall is also substantially formed from a titanium alloy in order to achieve said selected strength criteria with a minimum weight of wall material.

22. An improved lightweight cask assembly as defined in claim 21, further including a second shielding wall substantially formed from a radiation shielding material whose interior surface circumscribes the outer wall, and further including a second outer wall whose interior surface circumscribes the exterior surface of the second shielding wall, wherein the second outer wall is also substantially formed from a titanium alloy.

23. An improved lightweight cask assembly as defined in claim 22, wherein the first shielding wall is substantially formed from depleted uranium for absorbing gamma radiation.

24. An improved lightweight cask assembly as defined in claim 22, wherein said second shielding wall is substantially formed from a matrix of boron particles suspended in a matrix of silicone for absorbing neutrons.

25. An improved cask assembly for containing and transporting radioactive material of the type required to meet selected minimum strength and maximum weight criteria, comprising a cylindrical container structure having first and second shielding walls formed from depleted uranium and boron particles suspended in a matrix of silicone, respectively, and structural walls formed substantially from titanium including an outer wall, an intermediate wall and an inner wall, a reinforcing ring and an end plate assembly, wherein said first shielding wall is disposed between and supported by said inner and intermediate structural walls, and said second shielding wall is disposed between and supported by said intermediate and outer structural walls, the thickness of said inner wall being the minimum necessary to support said first shielding wall and achieve said strength criteria in order to minimize the distance between radioactive materials disposed in the interior of the cylindrical container structure and said first shielding wall, and wherein one end of said inner, outer and intermediate walls is joined together by said reinforcing ring, and wherein the other end of said inner, outer and intermediate walls is joined together by said end plate assembly.

26. An improved cask assembly as defined in claim 1, wherein said structural walls are formed from Ti-3-Al-2.5-V.

27. An improved cask assembly as defined in claim 11, wherein said structural walls are formed from Ti-3-Al-2.5-V.

28. An improved lightweight cask assembly as defined in claim 21, wherein said structural walls are formed from Ti-3-Al-2.5-V.

29. An improved cask assembly for containing and transporting a maximum amount of radioactive material in a cask structure of a selected maximum weight, minimum impact strength and maximum surface radiation, comprising a shielding wall formed from depleted uranium, and inner and outer structural walls circumscribing the inner and outer surfaces of the shielding wall for supporting said shielding wall, said inner wall defining the interior of the cask assembly where the radioactive material is contained, wherein the inner structural wall is substantially formed from a titanium alloy so that said minimum impact strength of said cask assembly may be achieved with an inner wall of minimum thickness, thereby minimizing the distance between said radioactive waste contained in the interior of the cask assembly and said shielding wall, and wherein said outer structural wall is also substantially formed from a titanium alloy so that said minimum impact strength may be achieved with a minimum amount of weight of wall material.

30. An improved cask assembly as defined in claim 29, wherein said inner and outer structural walls are formed from Ti-3-Al-2.5-V.

* * * * *